US006092353A

United States Patent [19]

Baumann

[11] Patent Number: 6,092,353

[45] Date of Patent: Jul. 25, 2000

[54] DEVICE FOR EXTRACTING OF THE CONTENTS OF AN ENVELOPE

[75] Inventor: Hervé Baumann, Paris, France

[73] Assignee: SECAP, Boulogne-Billancourt, France

[21] Appl. No.: 09/180,230

[22] PCT Filed: Mar. 21, 1997

[86] PCT No.: PCT/FR97/00501

§ 371 Date: Nov. 3, 1998

§ 102(e) Date: Nov. 3, 1998

[87] PCT Pub. No.: WO97/42039

PCT Pub. Date: Nov. 13, 1997

[30] Foreign Application Priority Data

May 3, 1996 [FR] France ..... 96 05564

[51] Int. Cl.[7] ..... B65B 43/26

[52] U.S. Cl. ..... 53/492; 53/381.3; 53/381.5

[58] Field of Search ..... 53/492, 381.1, 53/381.3, 381.5

[56] References Cited

U.S. PATENT DOCUMENTS

| | | | |
|---|---|---|---|
| 3,739,543 | 6/1973 | Harris . | |
| 4,866,915 | 9/1989 | Wise | 53/381.3 |
| 4,921,388 | 5/1990 | Nelson | 53/381.3 |
| 5,156,515 | 10/1992 | Charron et al. | 53/381.3 |
| 5,175,979 | 1/1993 | Van Der Werff et al. | 53/381.3 |
| 5,179,820 | 1/1993 | Van Der Werff | 53/381.5 |
| 5,983,609 | 11/1999 | Van Der Werff et al. | 53/492 |

FOREIGN PATENT DOCUMENTS

| | | |
|---|---|---|
| 0459 590 A1 | 5/1991 | European Pat. Off. . |
| 1 500 045 | 11/1968 | France . |
| 2 045 172 | 2/1971 | France . |
| 2 706 146 | 12/1994 | France . |
| WO 88/01543 | 3/1988 | WIPO . |

*Primary Examiner*—Eugene Kim

*Attorney, Agent, or Firm*—St. Onge Steward Johnston & Reens LLC

[57] ABSTRACT

A device for extracting the contents of an envelope pre-cut on three sides is provided. The device includes at least one bi-directional upper extraction roller, at least one bi-directional lower extraction roller cooperating with the upper extraction roller, and a receptacle for receiving the extracted contents of the pre-cut envelope. A controller causes the upper and lower extraction rollers to unfold the envelope and extract its contents by causing the upper and lower extraction rollers to move forward and rearward in accordance with the following successive steps: (a) the upper and lower extraction rollers move the envelope in a forward direction, the envelope being oriented with its uncut side facing a rearward direction; (b) the lower extraction rollers stop moving and the upper extraction rollers move an upper fold of the envelope in the rearward direction, whereby the upper fold is rounded and opened; (c) the upper and lower extraction rollers move the opened envelope and its contents in the forward direction until the contents are disengaged from the upper and lower extraction rollers, but the opened envelope is still held therebetween; and (d) the upper and lower extraction rollers abruptly cease to move, thereby causing the contents of the envelope to escape and be collected in the receptacle.

12 Claims, 10 Drawing Sheets

DEVICE FOR EXTRACTING OF THE CONTENTS OF AN ENVELOPE

FIELD OF THE INVENTION

The present invention concerns letter-openers designed to open correspondence on three sides, then to separate the contents from the envelope. It more precisely concerns a system permitting extraction of the contents from the envelope.

DESCRIPTION OF THE PRIOR ART

The present systems of extraction of correspondence perform the extraction of correspondence by separating the outside of the envelope from the contents, the envelope having been previously cut on three sides.

A first method, described for example in Document FR-A-2 706 146, utilizes one or two cylinders depressurized by a vacuum pump. The sides of the envelope are drawn by said cylinders and the contents are thus extracted with much efficacy. The great defect of this technology is the high sound level caused by the passage of air through the aspiration holes.

A second method utilizes the friction of a unit interposed in the path of the envelope. This friction may be caused by a shoe as in Document U.S. Pat. No. 3,739,543 or by a rotating brush, as in Document EP-A459 590. In both of these cases, the friction unit is brought into contact with the envelope by a mechanism.

The purpose of the invention is to propose a particular mechanism for extraction which allows obtaining a compact and unburdensome device.

SUMMARY OF THE INVENTION

The object of the invention is a device for the extraction of the contents of an envelope pre-cut on three sides, consisting of a frame, a means for carrying the pre-cut envelope in order to shift it on a path, a means of friction placed on the path of the envelope for its unfolding and the extraction of its contents, a means for receiving the empty envelopes, a means of receiving the extracted contents, and a means of control governing the synchronized operation of the preceding means, characterized in that the means of friction consists of abrasive units respectively above and below, forming a space for the movement of the envelope or its contents by friction and adjusted in order to move forward or rearward according to the following successive stages:

a) the upper and lower units move an envelope arriving with its uncut side at the back toward the front, b) the lower units do not move and the upper units move toward the rear, whereby the upper fold of the envelope is rounded and opened, c) the upper and lower units move the opened envelope and its contents forward until the contents are disengaged from the movement space, but the opened envelope is held there, d) the upper and lower units abruptly stop moving, which allows the contents to slip out in order to be collected in the means for reception of contents.

The means for reception of contents are suitably arranged to allow immediate visual inspection of the contents, which allows the operator who is present to make sure that addressee references are well available therefrom. He may then start the following stage:

e) the upper and lower units move the empty envelope rearward, toward the means for reception. In the contrary case, the operator can take the envelope and attach it to the opened correspondence, or even write in the addressee references.

In accordance with a very advantageous characteristic of the invention, the abrasive units consist of reciprocal rollers, which permits a very compact arrangement and an easy control of the rotation of the lower and upper rollers to obtain forward and rearward movement. The means of carriage may be comprised of antagonistic rollers.

Thus it is advantageous that a first motor control the rotation of the antagonistic rollers and the lower abrasive rollers to which the former may be connected by a kinematic chain with pulley and belt, while a second motor controls the rotation of the upper abrasive rollers. For the sake of compactness, it is always advantageous that the device include upstream means for carrying a higher feed-level of pre-cut full envelopes and a lower level of reception of empty envelopes, wherein the means of carriage are bi-directional. A gauge-head advantageously detects the passage of the envelope between the means of carriage and the means of extraction.

BRIEF DESCRIPTION OF THE DRAWINGS

The characteristics and advantages of the present invention are highlighted by the description below of an example of an embodiment illustrated in the drawings hereto attached. In these drawings.

DESCRIPTION OF THE INVENTION

Figure 1:
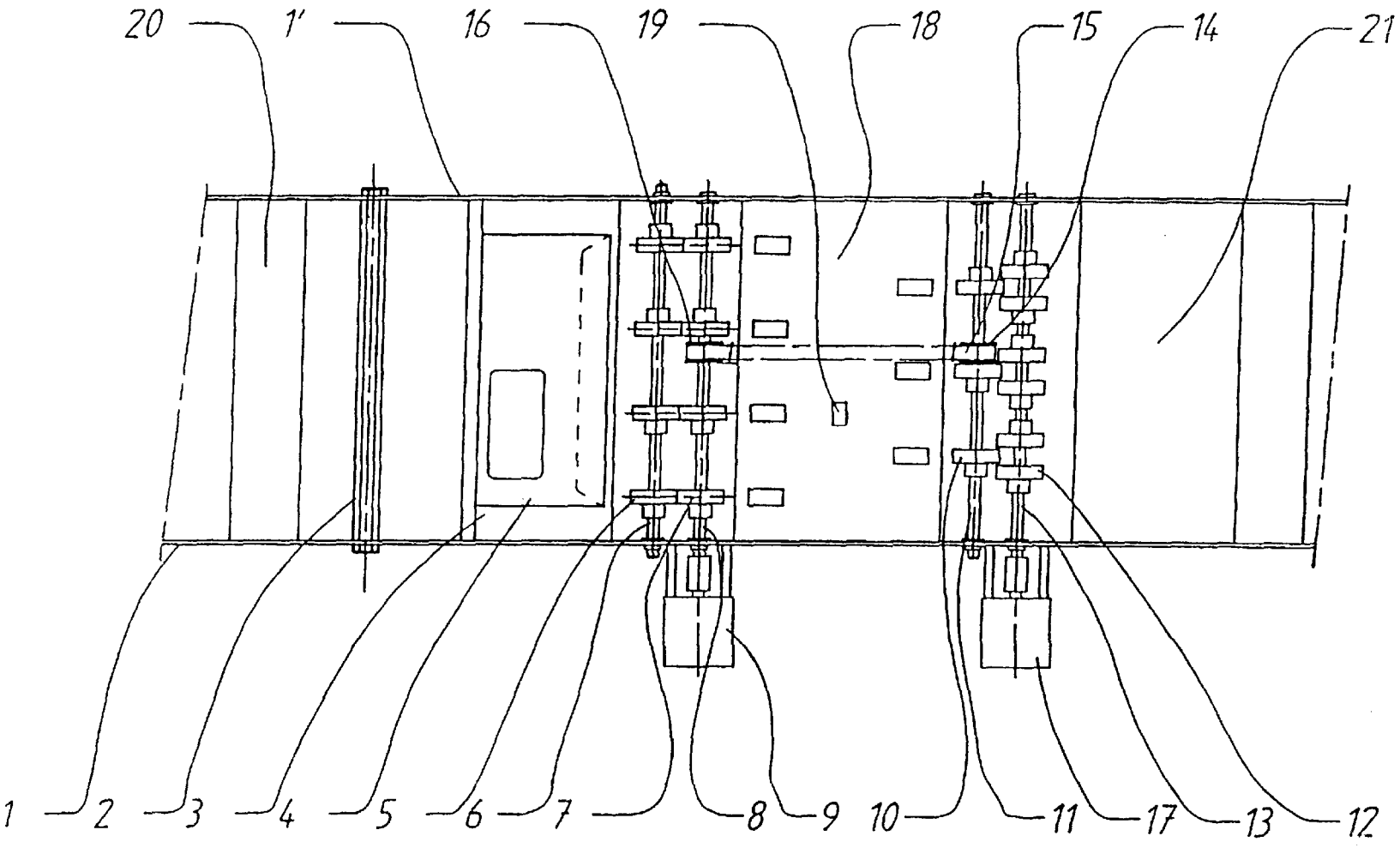
FIG. 1 is a developed sectional view of an extractor according to the present invention.
Figure 2:
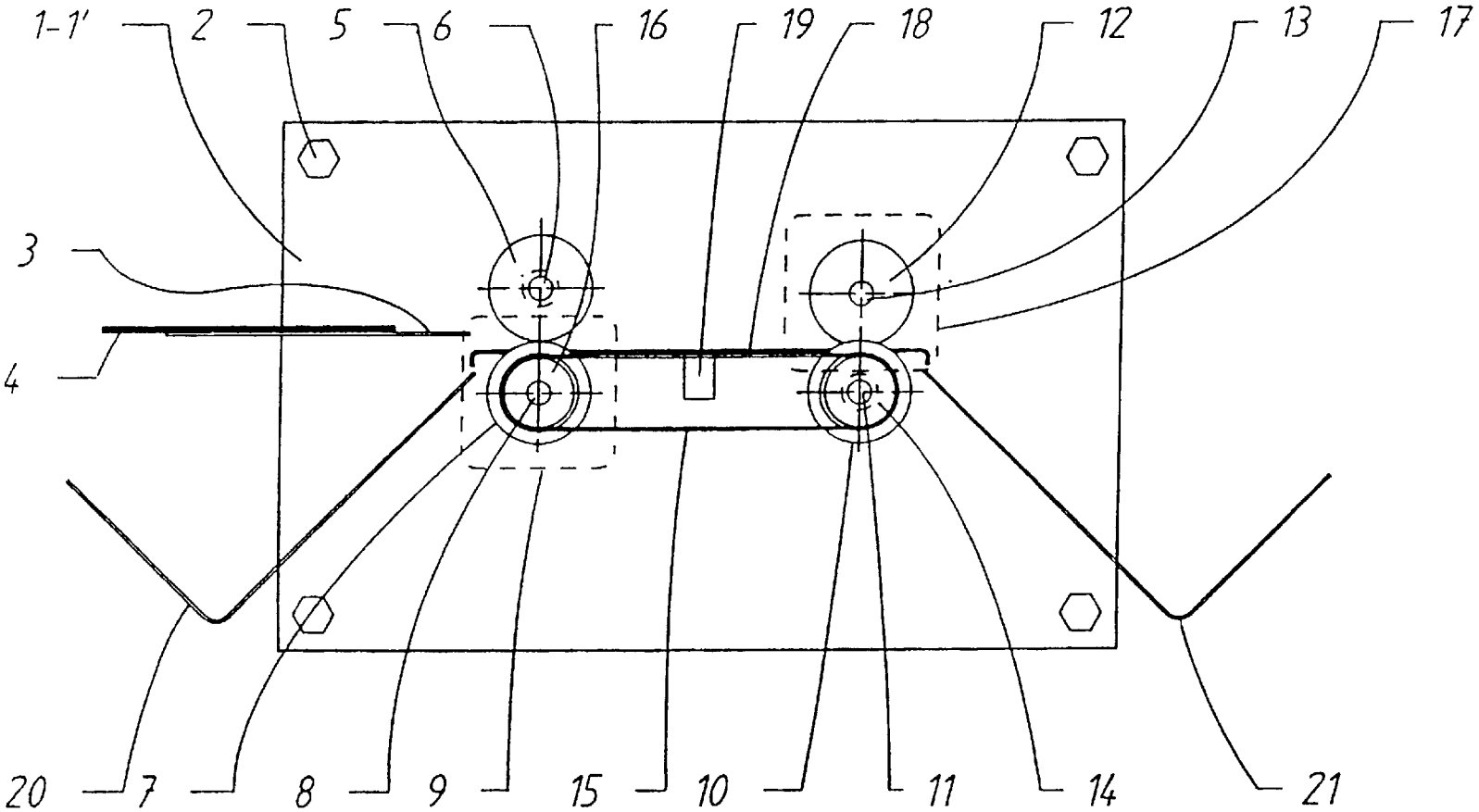
FIG. 2 shows a sectional profile view of FIG. 1, FIGS. 3, 4, 5, 6, 7, 8, 9 and 10 show inside profile views of FIG. 1 depicting each stage of operation of said extractor.

The extractor contains a principal structure consisting of Plates 1 and 1' and a certain number of struts 2 forming a frame. Inside this structure, the carriage zone of the envelopes comprises horizontal plate 3, mounted between plates 1 and 1'. The envelope 4 is provided cut on three sides by a mechanism not forming part of the invention. The carriage device comprises the rollers 5 mounted on arbor 6 and rollers 7 mounted on arbor 8. The rollers 5 are in contact with rollers 7. Rollers 7 are driven by motor 9 end-mounted on arbor 8 supporting rollers 7.

The extraction device comprises the rollers 10 mounted on arbor 11 and the pairs of rollers 12 mounted on arbor 13. Rollers 10 and 12 form a die; i.e. each roller 10 slightly penetrates into the pair of rollers 12 coupled so that an envelope can pass between the said rollers and slightly undulate. The rollers 10 are driven by motor 9 via the pulley and belt assembly 14, 15 and 16. The pairs of rollers 12 are driven by motor 17 end-mounted on arbor 13. Plate 18, mounted between plates 1 and 1', serves to guide the envelope from the carriage station to the extraction station. Plate 18 supports cell 19 which detects the passing of the envelope to its perpendicular.

The device is equipped with a tray 20 for reception of the emptied envelopes and a tray 21 for reception of the extracted letters. These two trays are mounted between plates 1 and 1'. A means of control regulates and synchronizes the carriage motors as well as the detection units. It consists preferably of a microprocessor.

The various necessary stages for obtaining a cycle of extraction of the contents of an envelope are shown in Figures numbered from 3 to 10.

Figure 3:
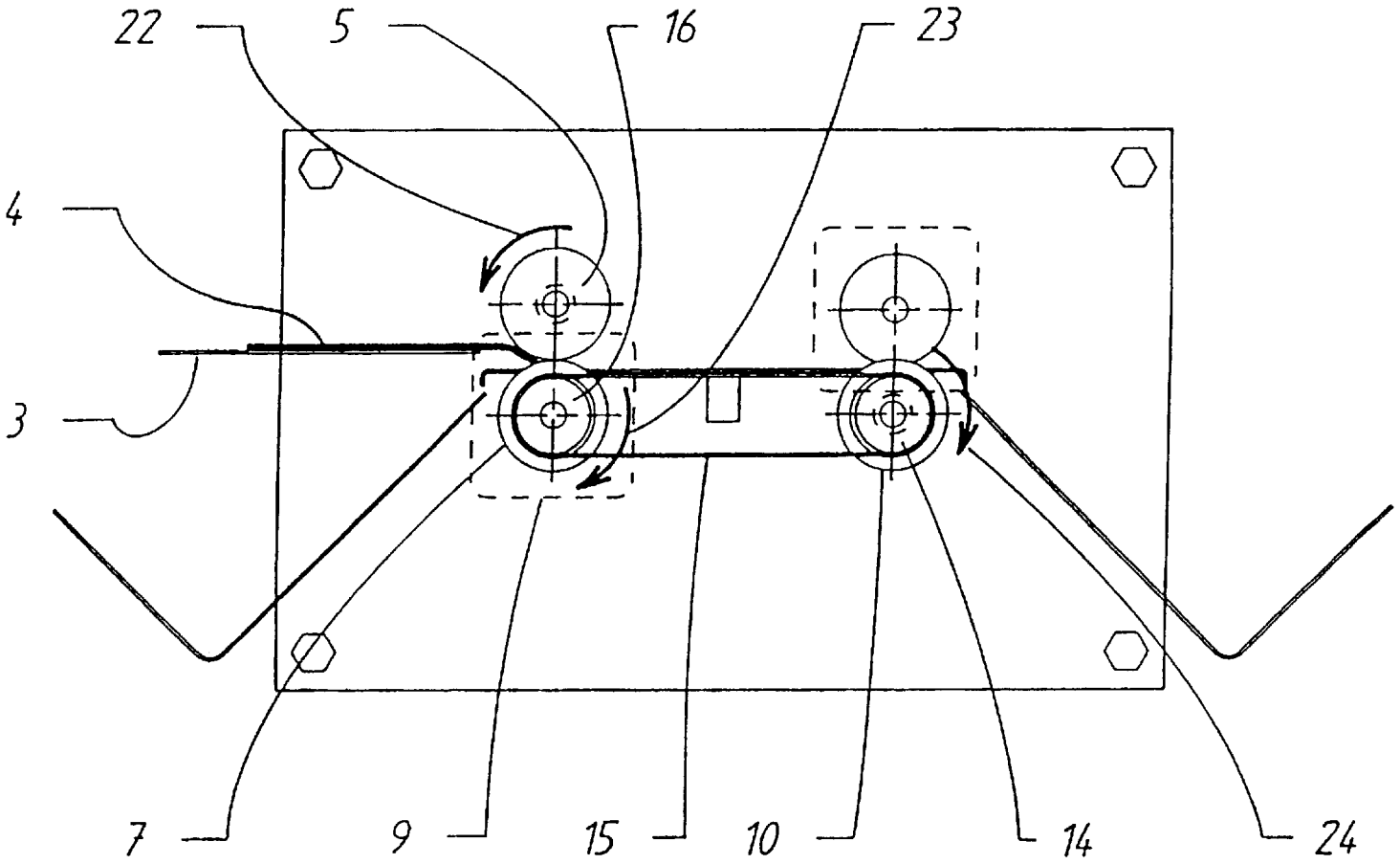

In FIG. 3, the device is in starting position. The means of control causes motor 9 to rotate clockwise. Rollers 5 and rollers 7 turn in accordance with the directions shown by arrows 22 and 23. Rollers 10, synchronized by pulleys-belt assembly 14, 15 and 16, turn in accordance with the direction shown by arrow 24. Loaded envelope 4, previously cut on three sides by a mechanism not forming part of the invention, is detected by rollers 5 and 7 and glides on plate 3.

Figure 4:
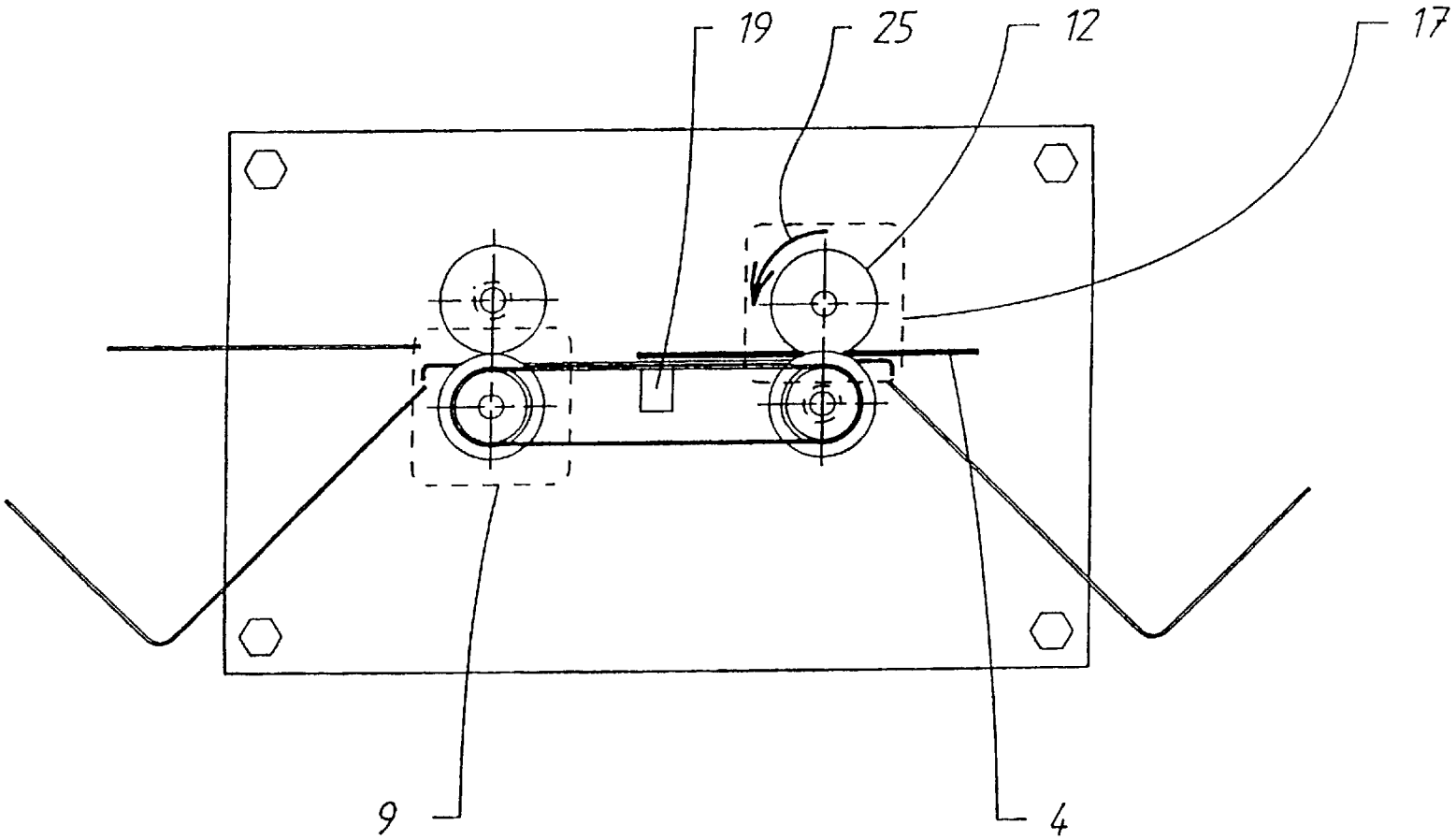

FIG. 4 shows the following stage. Transport of the envelope 4 is continued. This latter passes in front of cell 19. The control unit then causes motor 17 to rotate clockwise. Pairs of rollers 12 turn in accordance with the direction shown by arrow 25. When the envelope 4 is carried from its passage in front of cell 19, by an appropriate reading the control unit halts the carriage of the said envelope and stops motors 9 and 17.

Figure 5:
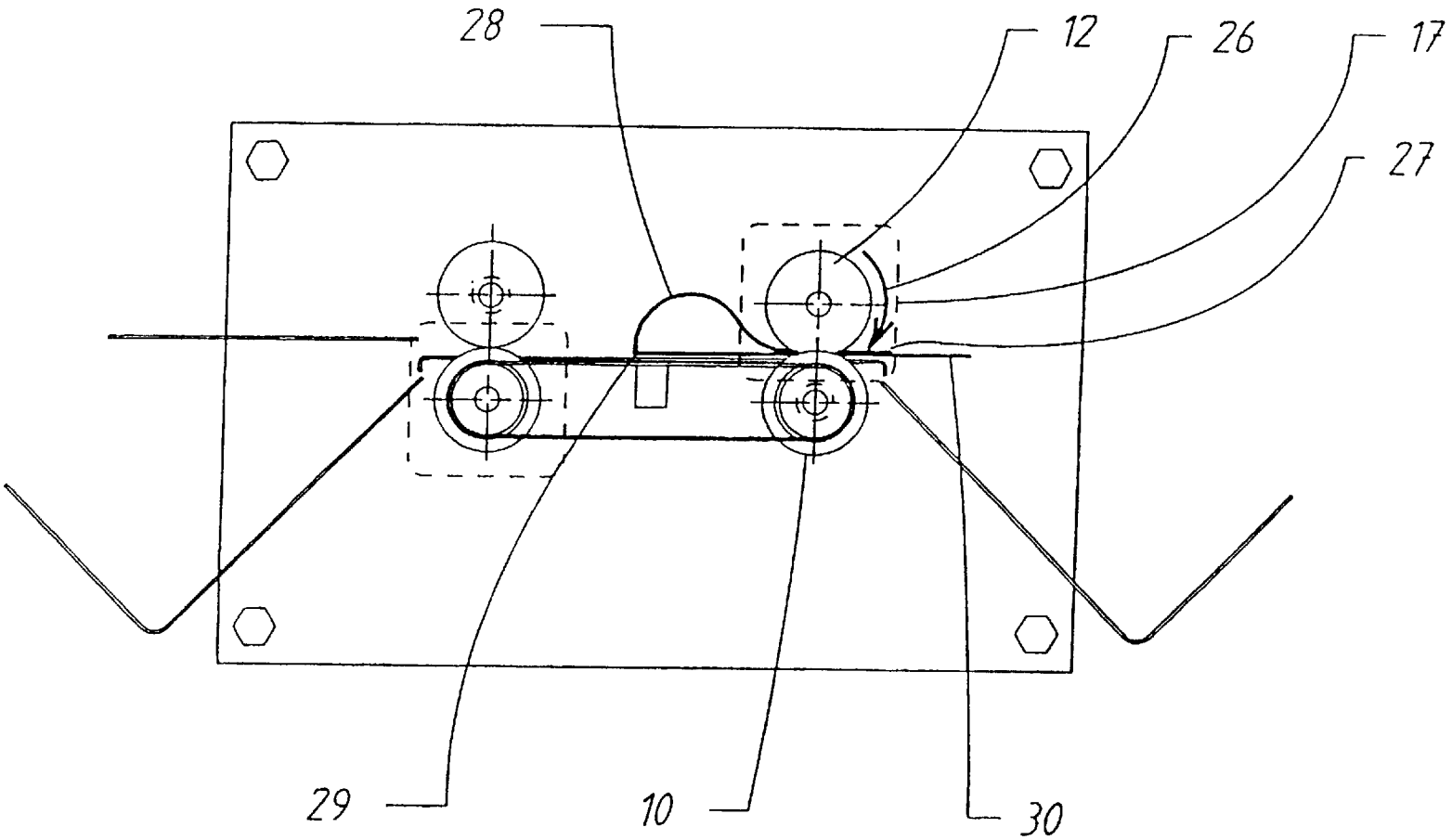

FIG. 5 shows the following stage. The rotation of motor 17 is reversed. Pairs of rollers 12 then turn in accordance with the direction shown by arrow 26. The upper part 27 of the envelope being in direct contact with rollers 12, a buckle 28 is formed from the hinge 29 of the envelope. The lower part 30 of the envelope and its contents stay immobile since, due to the die formed by rollers 12 and 10, it is in contact with the rollers 10, which are halted.

Figure 6:
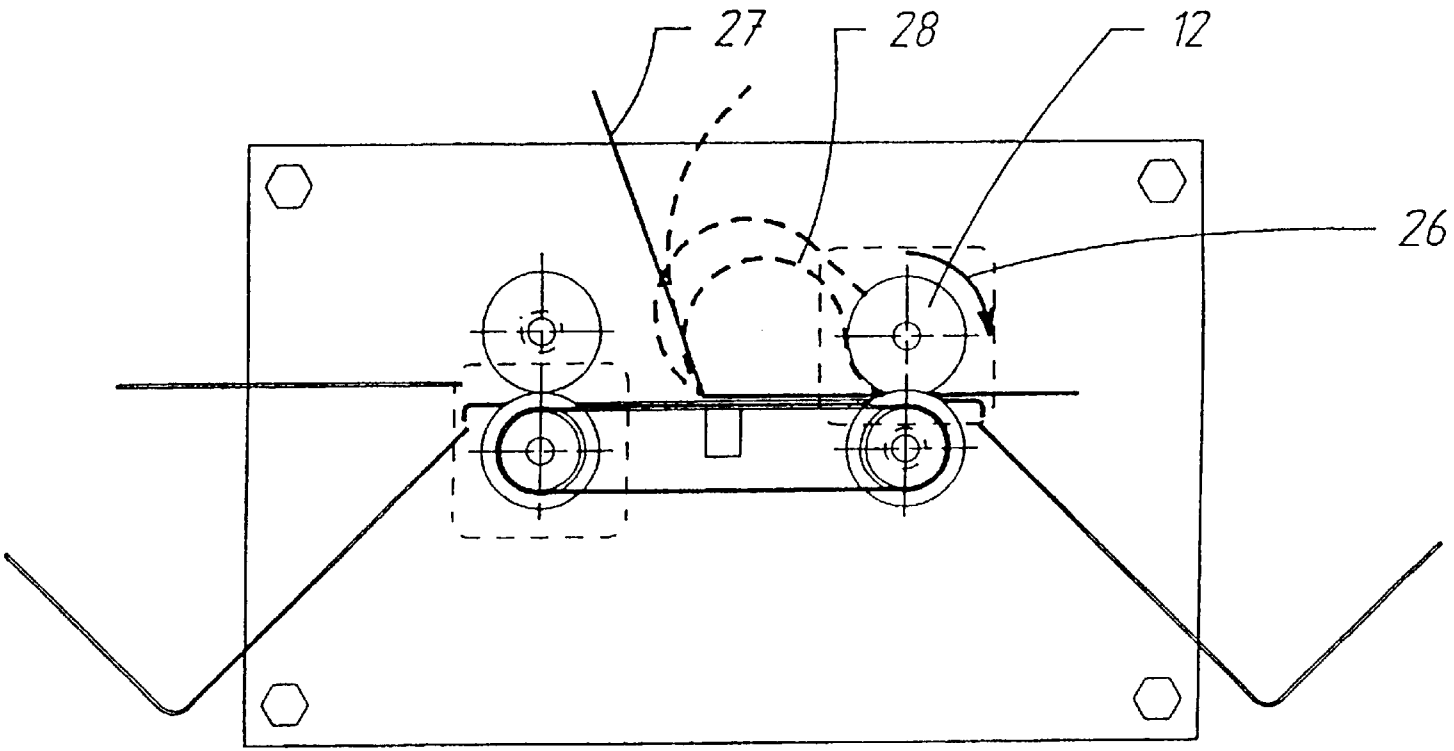

FIG. 6 shows the following stage. Pairs of rollers 12 continue their rotation in accordance with the direction shown by arrow 26; the buckle 28 expands until the extremity of upper part 27 is no longer in contact with the rollers 12.

Figure 7:
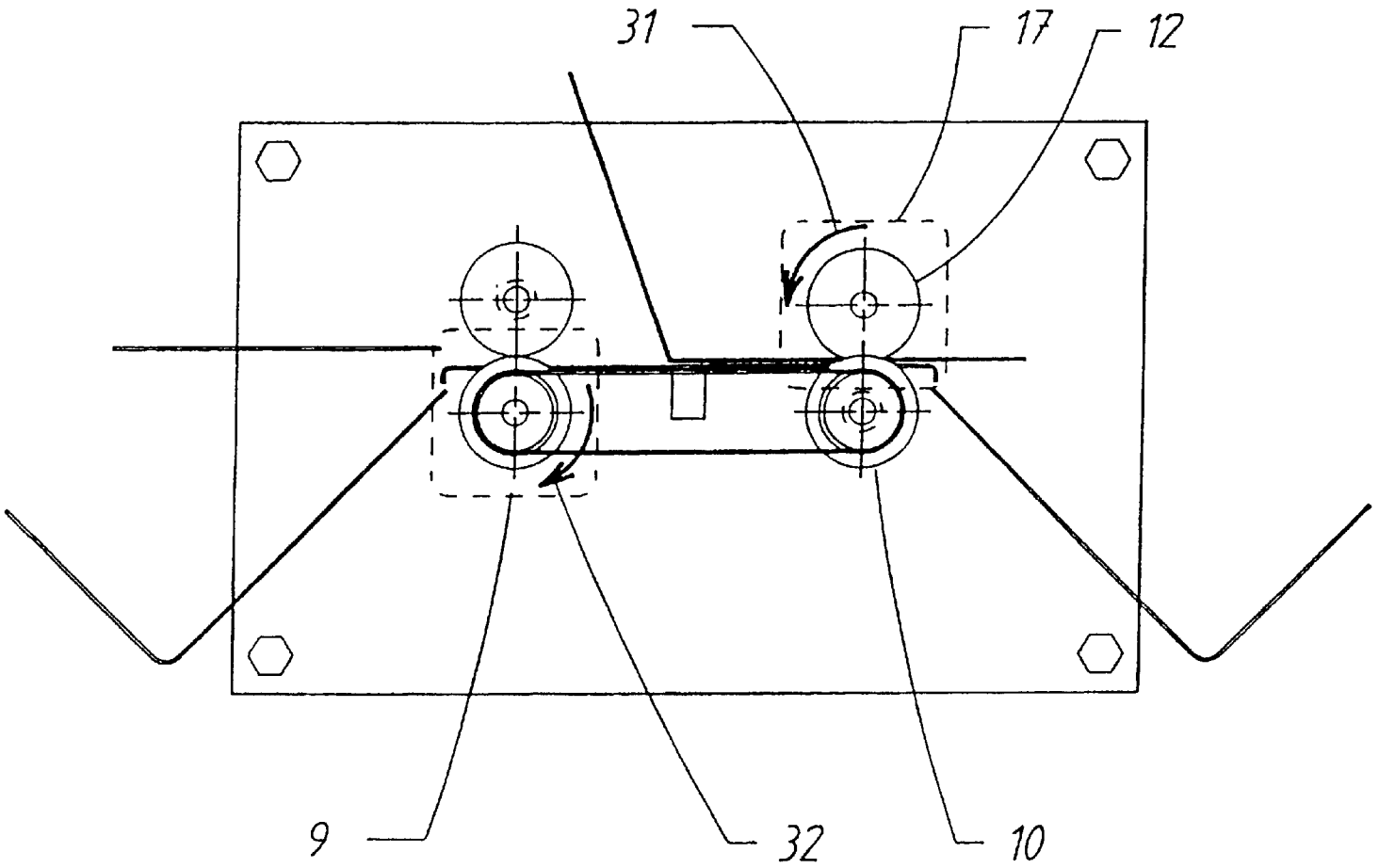

FIG. 7 shows the following stage. The control unit causes motors 9 and 17 to rotate so that rollers 10 and 12 turn in accordance with the direction shown by arrows 31 and 32.

Figure 8:
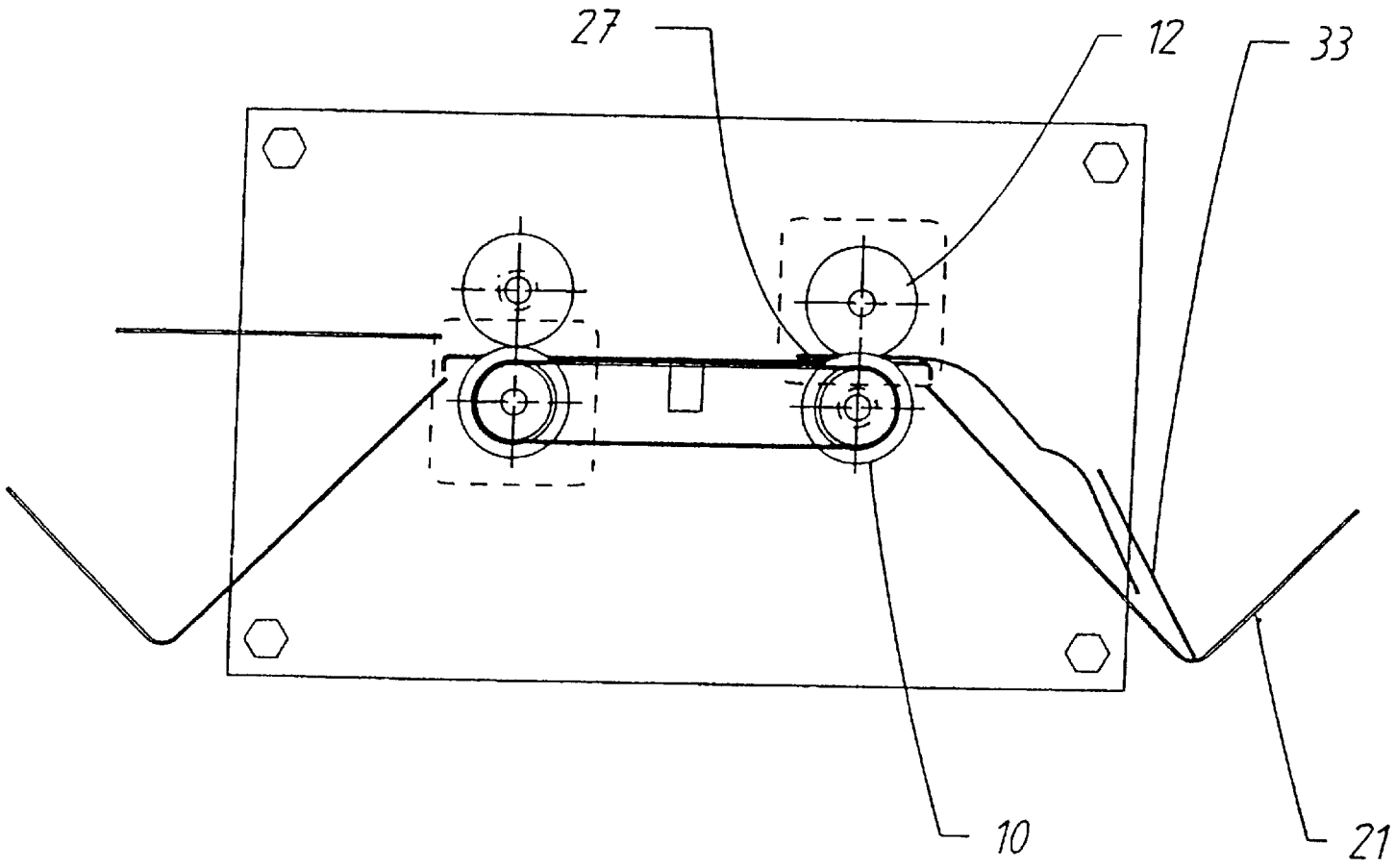

FIG. 8 shows the final stage. The control unit then abruptly stops the rotation of rollers 10 and 12. Only a small portion of the upper part 27 of the envelope remains locked in the die formed by rollers 12 and 10. The consequence of this abrupt deceleration is the ejection of the contents 33 of the envelope toward receiving tray 21. The operator visually verifies that the contents of the envelope was well extracted. Two cases are then shown.

Figure 9:
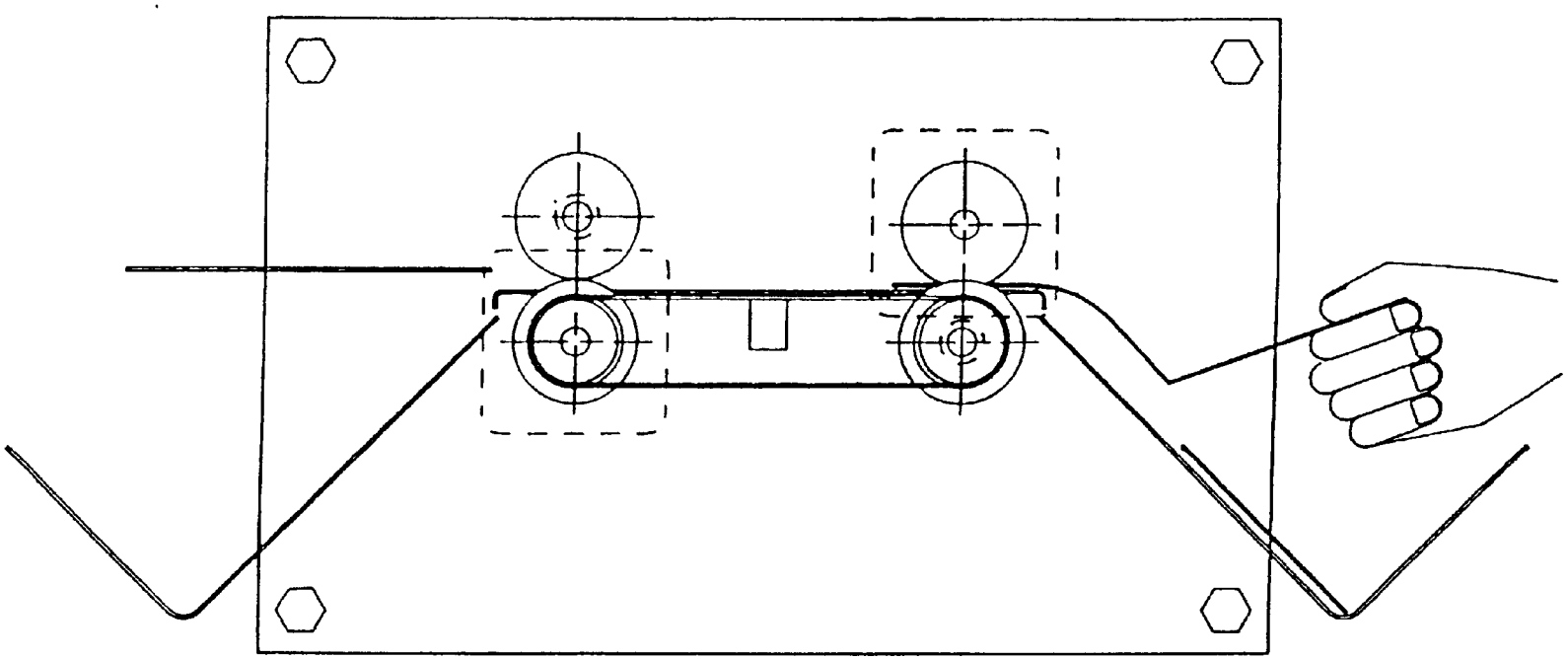

FIG. 9 shows the first case. The correspondence extracted does not carry the addressee references and the operator recovers the envelope and pulls on this latter in order to read the address written on the envelope.

Figure 10:
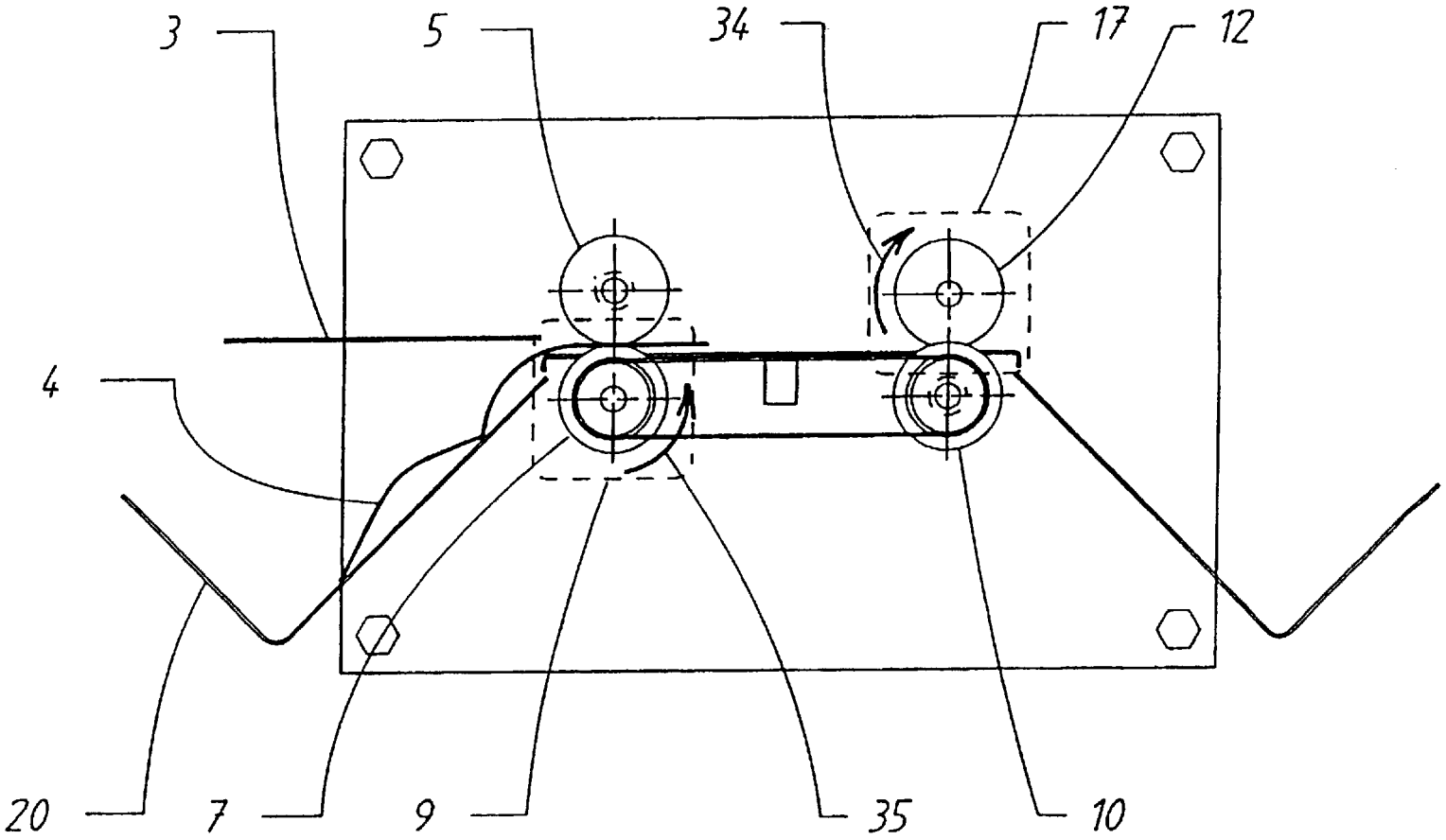

FIG. 10 shows the second case. The correspondence extracted carries the addressee references and the operator then launches the envelope 4 storage phase. The control unit causes rollers 5, 7, 10 and 12 to move in accordance with the directions shown by arrows 34 and 35. The unfolded envelope then glides under plate 3 and is stored in receiving tray 20 for empty envelopes.

What is claimed is:

1. A device for extracting the contents of an envelope pre-cut on three sides comprising:

at least one bi-directional upper extraction roller;

at least one bi-directional lower extraction roller cooperating with said upper extraction rollers;

a receptacle for receiving the extracted contents of the envelope; and a controller for causing said upper and said lower extraction rollers to unfold the envelope and extract its contents by causing said upper and said lower extraction rollers to move forward and rearward in accordance with the following successive steps:

a) said upper and said lower extraction rollers move the envelope in a forward direction, the envelope being oriented with its uncut side facing a rearward direction, b) said lower extraction rollers cease moving and said upper extraction rollers move an upper fold of the envelope in the rearward direction, whereby the upper fold is rounded and opened, c) said upper and said lower extraction rollers move the opened envelope and its contents in the forward direction until the contents are disengaged from said upper and said lower extraction rollers, but the opened envelope is still held therebetween, and d) said upper and said lower extraction rollers cease to move, thereby causing the contents of the envelope to escape and be collected in said receptacle.

2. The device for extracting the contents of an envelope of claim 1 further comprising a set of cooperating drive rollers for feeding the envelope to said upper and said lower extraction rollers.

3. The device for extracting the contents of an envelope of claim 2 further comprising a first motor for driving said drive rollers and said lower extraction rollers, and a second motor for driving said upper extraction rollers.

4. The device for extracting the contents of an envelope of claim 2 further comprising a sensor for detecting the passage of the envelope between said drive rollers and said upper and said lower extraction rollers.

5. The device for extracting the contents of an envelope of claim 1 further comprising an envelope tray for receiving the empty envelope and wherein said controller further causes said upper and said lower extraction rollers to perform the following step:

e) said upper and said lower extraction rollers move the empty envelope in the rearward direction to deposit the envelope in said envelope tray.

6. The device for extracting the contents of an envelope of claim 1 wherein said receptacle is arranged in order to permit the immediate visual inspection of the contents.

7. The device for extracting the contents of an envelope of claim 1 wherein said upper and said lower extraction rollers are arranged such that they overlap each other.

8. A device for extracting the contents of an envelope pre-cut on three sides comprising:

at least one bi-directional upper extraction roller;

at least one bi-directional lower extraction roller cooperating with said upper extraction rollers;

a set of cooperating drive rollers for feeding the pre-cut envelope to said upper and said lower extraction rollers;

sensor for detecting the passage of the envelope between said drive rollers and said upper and said lower extraction rollers;

a first motor for driving said drive rollers and said lower extraction rollers;

a second motor for driving said upper extraction rollers;

a receptacle for receiving the extracted contents of the pre-cut envelope;

an envelope tray for receiving the empty envelope; and a controller for causing said first and said second motors to drive said upper and said lower extraction rollers to unfold the envelope and extract its contents by driving said upper and said lower extraction rollers forward and rearward in accordance with the following successive steps:

a) said upper and said lower extraction rollers move the envelope in a forward direction, the envelope being oriented with its uncut side facing a rearward direction, b) said lower extraction rollers cease moving and said upper extraction rollers move an upper fold of the envelope in the rearward direction, whereby the upper fold is rounded and opened, c) said upper and said lower extraction rollers move the opened envelope and its contents in the forward direction until the contents are disengaged from said upper and said lower extraction rollers, but the opened envelope is still held therebetween, and d) said upper and said lower extraction rollers cease to move, thereby causing the contents of the envelope to escape and be collected in said receptacle, and e) said upper and said lower extraction rollers move the empty envelope in the rearward direction to deposit the envelope in said envelope tray.

9. The device for extracting the contents of an envelope of claim 8 wherein said receptacle is arranged in order to permit the immediate visual inspection of the contents.

10. The device for extracting the contents of an envelope of claim 8 wherein said upper and said lower extraction rollers are arranged such that they overlap each other.

11. A method for extracting the contents of an envelope pre-cut on three sides using a device comprising at least one bi-directional upper extraction roller, at least one bi-directional lower extraction roller cooperating with the upper extraction rollers, a receptacle for receiving the extracted contents of the pre-cut envelope, and a controller for causing the upper and lower extraction rollers to unfold the envelope and extract its contents, the method comprising the steps of:

driving the upper and the lower extraction rollers to move the envelope in a forward direction, the envelope being oriented with its uncut side facing a rearward direction;

stopping the lower extraction rollers and driving the upper extraction rollers to move an upper fold of the envelope in the rearward direction, whereby the upper fold is rounded and opened;

driving the upper and the lower extraction rollers to move the opened envelope and its contents in the forward direction until the contents are disengaged from the upper and the lower extraction rollers, but the opened envelope is still held therebetween, and abruptly stopping the upper and the lower extraction rollers, thereby causing the contents of the envelope to escape and be collected in the receptacle.

12. The method for extracting the contents of an envelope of claim 11 wherein the device further comprises an envelope tray for receiving the empty envelope, and further comprising the step of driving the upper and the lower extraction rollers to move the empty envelope in the rearward direction to deposit the envelope in the envelope tray.

* * * * *